US007372008B2

(12) United States Patent
Ohta et al.

(10) Patent No.: US 7,372,008 B2
(45) Date of Patent: May 13, 2008

(54) IMAGE HEATING APPARATUS WITH ELECTRIC POWER SUPPLY STOP MEANS

(75) Inventors: Tomoichiro Ohta, Kashiwa (JP); Manabu Yamauchi, Kashiwa (JP); Hiroto Nishihara, Toride (JP); Kenji Fukushi, Toride (JP); Yasuyuki Aiko, Toride (JP); Hidehiko Kinoshita, Kashiwa (JP); Takamitsu Hirayama, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/304,732

(22) Filed: Dec. 16, 2005

(65) Prior Publication Data

US 2006/0131301 A1 Jun. 22, 2006

(30) Foreign Application Priority Data

Dec. 20, 2004 (JP) ..... 2004-367623

(51) Int. Cl.
*H05B 6/14* (2006.01)
*G03G 15/20* (2006.01)

(52) U.S. Cl. ..... 219/619; 219/667; 399/328; 399/330

(58) Field of Classification Search ..... 219/619, 219/667; 399/328–338
See application file for complete search history.

(56) References Cited

U.S. PATENT DOCUMENTS

| | | | | |
|---|---|---|---|---|
| 7,030,345 | B2 * | 4/2006 | Nishihara et al. | 219/619 |
| 2003/0068169 | A1 * | 4/2003 | Suzuki | 219/619 |
| 2004/0037580 | A1 * | 2/2004 | Ohta | 399/69 |
| 2006/0157475 | A1 | 7/2006 | Nishihara et al. | 219/619 |

FOREIGN PATENT DOCUMENTS

| | | |
|---|---|---|
| JP | 2000-39796 | 2/2000 |
| JP | 2000-39797 | 2/2000 |

OTHER PUBLICATIONS

Translation of Chinese Office Action dated Nov. 16, 2007, in Chinese Application No. 200510121757.7.

* cited by examiner

*Primary Examiner*—Philip H. Leung
(74) *Attorney, Agent, or Firm*—Fitzpatrick, Cella, Harper & Scinto

(57) ABSTRACT

An image heating apparatus has a magnetic flux generator; a heat generating element for generating heat by a magnetic flux generated by the magnetic flux generator, the heat generating element being effective to heat an image on a recording material; an electric power supply for supplying electric power to the magnetic flux generator; electric power changing unit for changing electric power to be supplied to the magnetic flux generator on the basis of a temperature rise property of the heat generating element, in a period from start of electric power supply to the magnetic flux generator to reaching of a temperature of the heat generating element to a predetermined level.

6 Claims, 9 Drawing Sheets

IMAGE HEATING APPARATUS WITH ELECTRIC POWER SUPPLY STOP MEANS

FIELD OF THE INVENTION AND RELATED ART

The present invention relates to an image heating apparatus which heats an image on recording medium with the use of an inductive heating method. More specifically, it relates to an image heating apparatus which employs an inductive heating method and is suitable as an apparatus for adding gloss to an image on recording medium, and also, a fixing apparatus.

Japanese Laid-open Patent Application 2000-39796 discloses an image heating apparatus, as a fixing apparatus, which uses, as the material for its heating member, a magnetic conductor (substance in which heat is generated by electromagnetic induction), the Curie point of which equals the fixation temperature of the heating apparatus. As a magnetic conductor is heated close to its Curie point, it increases in specific heat; it increases in internal energy. Thus, as a magnetic conductor is heated past its Curie point, it loses its spontaneous magnetization, preventing thereby heat from being generated therein. Therefore, by using a magnetic conductor, as the material for the heating member, the Curie point of which equals the temperature level necessary for image fixation, it is possible to make the heating member control itself in temperature so that as the temperature of the fixation roller rises close to the fixation temperature, which equals the Curie point of the magnetic conductor used as the material for the heating member, the heating member automatically stops increasing in temperature.

Japanese Laid-open Patent Application 2000-39797 proposes a fixing apparatus which heats an image on recording medium by heating its heating member by electromagnetic induction. The heating member of this fixing apparatus is formed of a magnetic conductor, the Curie point of which has been set so that the saturation temperature of the magnetic conductor (fixation roller) falls within a temperature range which is no less than the fixation temperature, but, no more than the hot-offset start temperature. Here, the saturation temperature of a magnetic conductor is the temperature level which the magnetic conductor does not exceeds, due to the above described characteristic of the fixation roller (magnetic conductor) that it controls itself in temperature as it is heated through electromagnetic induction. With the employment of this design, not only is it possible to eliminate the problem that the warmup time increases because the speed at which the heating member (magnetic conductor) increases in temperature, decreases, due to the phenomenon that as the temperature of the heating member approaches the Curie point of the magnetic conductor, of which the heating member is formed, but also, it is possible to prevent the hot-offset.

The Curie point of a magnetic conductor can be changed by changing its composition. For example, a desired Curie point can be achieved by changing in composition (compositional modification), a magnetic conductor composed of the combination of iron and nickel, combination of iron, nickel, and chrome, etc.

1) The following heating member has been known as a countermeasure for the phenomenon that as multiple sheets of recording medium of a small size are continuously conveyed through a fixing apparatus which employs an inductive heating method, the out-of-sheet-path portions of the heating member, that is, portions of the heating member of the fixing apparatus, which are between the edges of the path of a sheet of the small size and the corresponding edges of the path of a sheet of recording medium of the largest size conveyable through the fixing apparatus, abnormally increases in temperature. That is, there has been known a heating member (fixation roller) formed of a magnetic conductor, the Curie point of which has been adjusted to a desired level (for example, its Curie point is set to a value which is no less than fixation point and no more than high temperature offset point, or no more than the highest point in temperature the apparatus can withstand) (hereafter, such fixation roller may be referred to as Curie point fixation roller). In order to prevent this fixation roller from abnormally rising in temperature, this heating member (fixation roller) takes advantage of one of the properties of the magnetic conductor, of which it is made, that is, the property that as the temperature of a magnetic conductor increases close to the Curie point of the magnetic conductor, the magnetic conductor reduces in the efficiency with which heat is generated therein (this phenomenon hereafter may be referred to as Curie point property). However, the Curie point is one of the specific properties of a magnetic conductor having a Curie point. Therefore, if a Curie point roller designed to have a specific Curie point value is manufactured in a substantial numbers, they will not be uniform in Curie point; the actual Curie points of some of the rollers will be different from the preset Curie point. Therefore, it is possible that a fixing apparatus will be fitted with a Curie point fixation roller, the Curie point of which is different from the preset one by the amount outside the tolerance range. Further, a Curie point fixation roller itself sometimes changes in Curie point value due to wear and/or deterioration, making it therefore possible that it will deviate in Curie point value by an amount outside the tolerance range.
2) In reality, there are many types of a fixing apparatus, which are changeable in fixation temperature, and therefore, many types of a Curie point fixation roller, which are different in Curie point, are available for each type of a fixing apparatus. As long as each type of a fixing apparatus is fitted with a matching Curie point fixation roller, there will be no problem. However, there are many type of a Curie point rollers mountable in each type of a fixing apparatus as described above. Therefore, it is possible that a fixing apparatus is fitted with a fixation roller for a fixing apparatus of a different type.
3) Some fixing apparatuses are designed so that their fixation rollers can be easily exchanged by a user, making it possible that a fixation roller for another type of an image forming apparatus will be accidentally mounted by a user. In such a case, a Curie point fixation roller meant for an image forming apparatus of a different type is mounted.

In each of the above described cases 1)-3), a mismatch occurs between the Curie point fixation roller and the control system of the fixing apparatus, preventing therefore the fixation process from being properly controlled.

SUMMARY OF THE INVENTION

Thus, the primary object of the present invention is to provide a heating apparatus capable of determining whether or not a heating member mounted therein is a correct one.

Another object of the present invention is to control the process of heating a heating member, according to the characteristic of the heating member in the heating apparatus regarding temperature increase, in order to make the fixing apparatus to optimally operate.

Another object of the present invention is to make it possible to properly control the heating process, regardless of the nonuniformity in the characteristic of a heating apparatus regarding temperature increase.

Another object of the present invention is to make it possible to properly control the heating process, even if a heating member, which has been mounted in a fixing apparatus, does not match in type with the fixing apparatus.

As for the typical structure of the image heating apparatus in accordance with the present invention for achieving the above described objects, the image heating apparatus which comprises: a magnetic flux generating means; a heating member in which heat is generated by the magnetic flux from the magnetic flux generating means; and an electric power supplying means for supplying the magnetic flux generating means with electric power, and which heats an image on recording medium by the heat generated in the heating member, is characterized in that it also comprises an electric power changing means for changing the electric power supplied to the magnetic flux generating means, according to the characteristic of the heating member regarding its temperature increase, during the period from when the magnetic flux generating means begins to be supplied with electric power to when the temperature of the heating member reaches a preset level.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

(1) Example of Image Forming Apparatus

Figure 1:
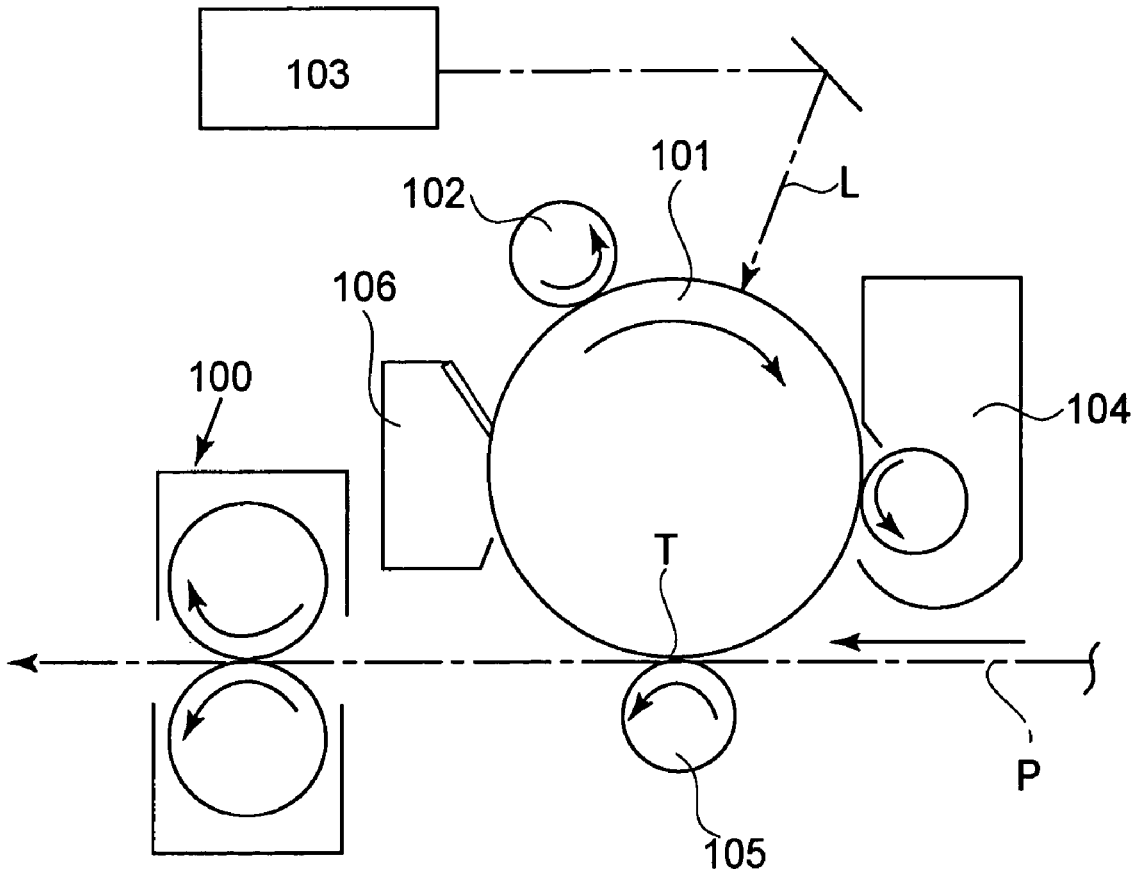
FIG. 1 is a schematic drawing of the image forming apparatus in the first embodiment of the present invention, showing the general structure thereof.

FIG. 1 is a schematic drawing of the image forming apparatus in this embodiment of the present invention, showing the general structure thereof. The image forming apparatus in this embodiment is a laser copying machine (printer) of the transfer type, which employs one of the electrophotographic processes.

Designated by a referential symbol 101 is an electrophotographic photosensitive member, as an image bearing member, in the form of a rotatable drum (which hereinafter will be referred to as photosensitive drum), which is rotationally driven in the clockwise direction indicated by an arrow mark in the drawing, at a preset peripheral velocity.

Designated by a referential symbol 102 is a charge roller as a charging means, which uniformly charges the peripheral surface of the rotating photosensitive drum 101, to preset polarity and potential level.

Designated by a referential symbol 103 is a laser scanner, which scans the uniformly charged peripheral surface of the rotating photosensitive drum 101, with a beam of laser light L which it outputs while modulating the beam of laser light L with sequential digital video signals in accordance with the image formation data; the peripheral surface of the photosensitive drum 101 is exposed by the laser scanner. As a result, an electrostatic latent image, which matches the pattern in which the peripheral surface of the photosensitive drum 101 has been exposed, is formed on the peripheral surface of the photosensitive drum 101.

Designated by a referential symbol 104 is a developing apparatus, which develops, normally or in reverse, the electrostatic latent image on the peripheral surface of the photosensitive drum 101 into a visible image formed of toner (which hereinafter will be referred to simply as toner image).

Designated by a referential symbol 105 is a transfer roller as a transferring means, which is kept pressed upon the peripheral surface of the photosensitive drum 101 with the application of a preset amount of pressure, forming a transfer nip T. To this transfer nip T, a sheet P of recording medium is conveyed from an unshown sheet feeding mechanism, with a preset control timing, and the sheet P is conveyed through the transfer nip T while remaining pinched between the transfer roller 105 and photosensitive drum 101. While the sheet P is conveyed through the transfer nip T, a preset transfer bias is applied to the transfer roller 105, with a preset control timing. As a result, the toner image on the peripheral surface of the photosensitive drum 101 is electrostatically transferred in a manner of being peeled away from the photosensitive drum 101, onto one of the surfaces of the sheet P of recording medium which is being conveyed through the transfer nip T while remaining pinched between the roller 105 and drum 101.

After being conveyed out of the transfer nip T, the sheet P of recording medium is separated from the peripheral surface of the photosensitive drum 101, and is introduced as an object to be heated, into a fixing apparatus 100, which fixes the unfixed toner image on the introduced sheet P of recording medium to the sheet P, with the application of heat and pressure, turning thereby the unfixed toner image into a permanent image, and discharges the sheet P therefrom.

Designated by a referential symbol 106 is a cleaning device for cleaning the photosensitive drum 101, which is for removing the transfer residual toner, that is, the toner remaining on the peripheral surface of the photosensitive drum 101 after the separation of the sheet P of recording medium from the peripheral surface of the photosensitive drum 101. After the cleansing of the peripheral surface of the photosensitive drum 101, that is, the removal of the transfer residual toner from the peripheral surface of the photosensitive drum 101, the peripheral surface of the photosensitive drum 101 is used for the following image formation.

(2) Fixing Apparatus 100

Figure 2:
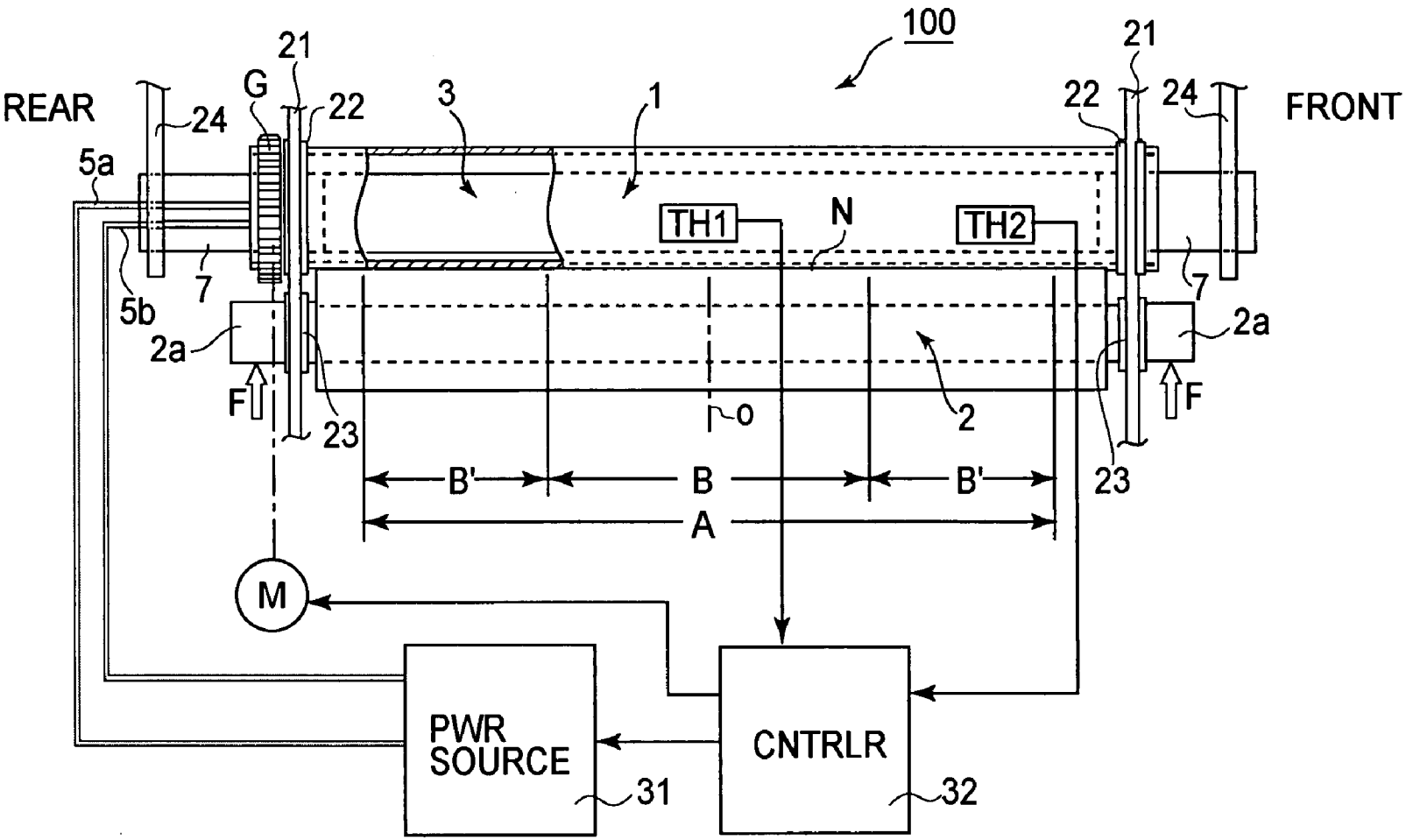
FIG. 2 is a schematic front view of the partially cutaway view of the fixing apparatus.
Figure 3:
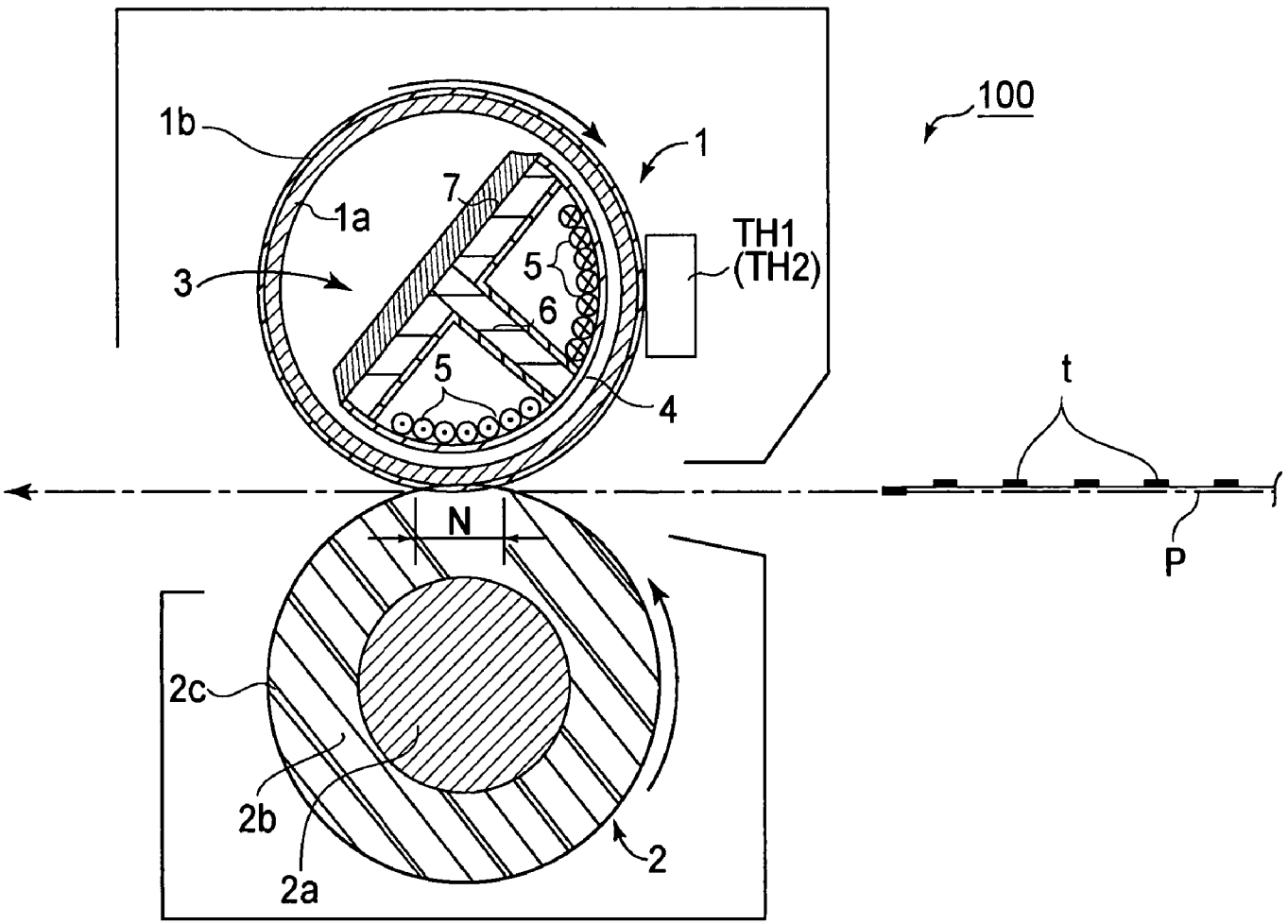
FIG. 3 is an enlarged schematic sectional view of the essential portions of the fixing apparatus.

The fixing apparatus 100 is an image heating apparatus which uses the inductive heating method in accordance with the present invention. FIG. 2 is a partially cutaway schematic front view of this fixing apparatus 100, and FIG. 3 is an enlarged schematic view of the essential portions of the fixing apparatus 100.

Designated by a referential symbol 1 is a fixation roller as a heat generating member (heating member) in the form a hollow cylinder, and designated by a referential symbol 2 is an elastic pressure roller as a pressure applying member. The two rollers 1 and 2 are disposed in parallel, with the fixation roller 1 positioned above the pressure roller 2. The two rollers 1 and 2 are kept pressed upon each other, forming a fixation nip N (heating nip). Designated by a referential symbol 3 is an excitation assembly, which is disposed in the hollow of the fixation roller 1; the excitation assembly 3 is inserted into the fixation roller 1.

The fixation roller 1 is made up essentially of a sleeve 1*a* as the main portion thereof, and a surface layer 1*b* coated on the peripheral surface of the sleeve 1*a*. The sleeve 1*a* is roughly 300 μm in thickness, and is formed of a magnetic conductor, more specifically, an iron alloy (Fe—Cr—Ni), composed so that its Curie point became a temperature level of TR3, which is higher by a preset value than the fixation temperature TR2 (fixation-possible temperature level), that is, the image heating temperature of this apparatus. In other words, the fixation roller 1 is a Curie point roller. The fixation roller 1 may be provided with an elastic layer or the like, in addition to the surface layer 1*b* which functions as a toner releasing layer. The Curie point TR3 of this fixation roller 1 has been set to be higher than the fixation temperature and below the hot offset start point. The upper limit for the Curie point of the fixation roller 1 may be set to be no higher than the highest temperature which the heating apparatus can withstand. For example, the Curie point may be set to be no higher than the highest temperature (230° C.) which the sheath of the excitation coil can withstand. With the Curie point of the fixation roller 1 set to such a temperature level, it is possible to prevent the apparatus from becoming damaged due to the abovementioned abnormal increase in the temperature of the fixation roller.

This fixation roller 1 is rotatably supported by the rear and front lateral plates 21 and 21 of the fixing apparatus, with a pair of bearings 22 and 22 placed between the lengthwise ends of the fixation roller 1, one for one.

As for the pressure roller 2, it is made up of a metallic core 2*a*, a heat resistant elastic layer 2*b*, and a toner releasing surface layer 2*c*. It is disposed under the fixation roller 1, in parallel to the fixation roller 1. It is rotatably supported by the rear and front lateral plates 21 and 21 of the fixing apparatus, with a pair of bearings 23 and 23 placed between the lengthwise ends of the pressure roller 2, and rear and front lateral plates 21 and 21,one for one. The bearings 23 and 23 are attached to the lateral plates 21 and 21 so that they can be movable in the direction perpendicular to the axial line of the fixation roller 1. Further, the bearing 23 and 23 are kept pressed upward with the use of unshown pressure applying means such as compression springs, pressing thereby the pressure roller 2 upon the downwardly facing portion of the peripheral surface of the fixation roller 1 with the application of preset amounts of pressure F and F, against the resiliency of the elastic layer 2*b* so that the fixation nip N, shown in FIG. 3, having a preset width in the sectional view in FIG. 3.

Designated by a referential symbol G is a gear for driving the fixation roller 1, which is firmly attached to the lengthwise rear end of the fixation roller 1. As driving force is transmitted to this gear G from a driving force source M, the fixation roller 1 is rotated in the clockwise direction in FIG. 3, at a preset peripheral velocity. As the fixation roller 1 is rotated, the pressure roller 2 is rotated by the torque transmitted to the pressure roller 2 from the fixation roller 1 by the friction which occurs between the two rollers 1 and 2, in the fixation nip N.

The excitation assembly 3 is inserted into the hollow of the fixation roller 1, being firmly supported between and by the rear and front supporting members 24 and 24, with the lengthwise front and rear ends of the excitation assembly 3 firmly attached to the supporting members 24 and 24, so that a preset amount of gap is created and maintained between the internal surface of the fixation roller 1 and the excitation assembly 3, and also, so that the excitation assembly 3 is positioned at a preset angle in terms of the rotational direction of the fixation roller 1.

Figure 4:
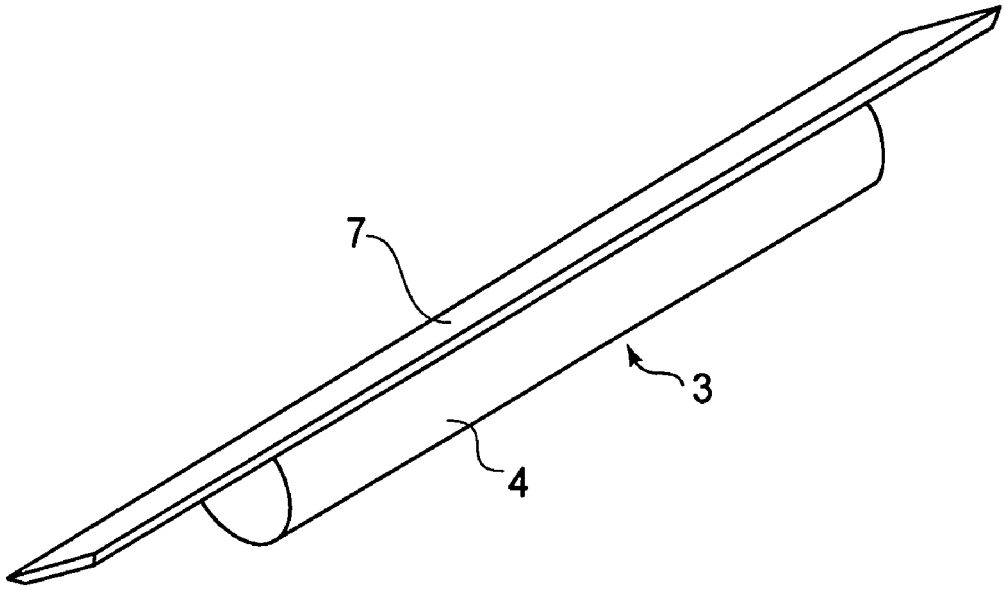
FIG. 4 is a schematic perspective view of the excitation assembly.
Figure 5:
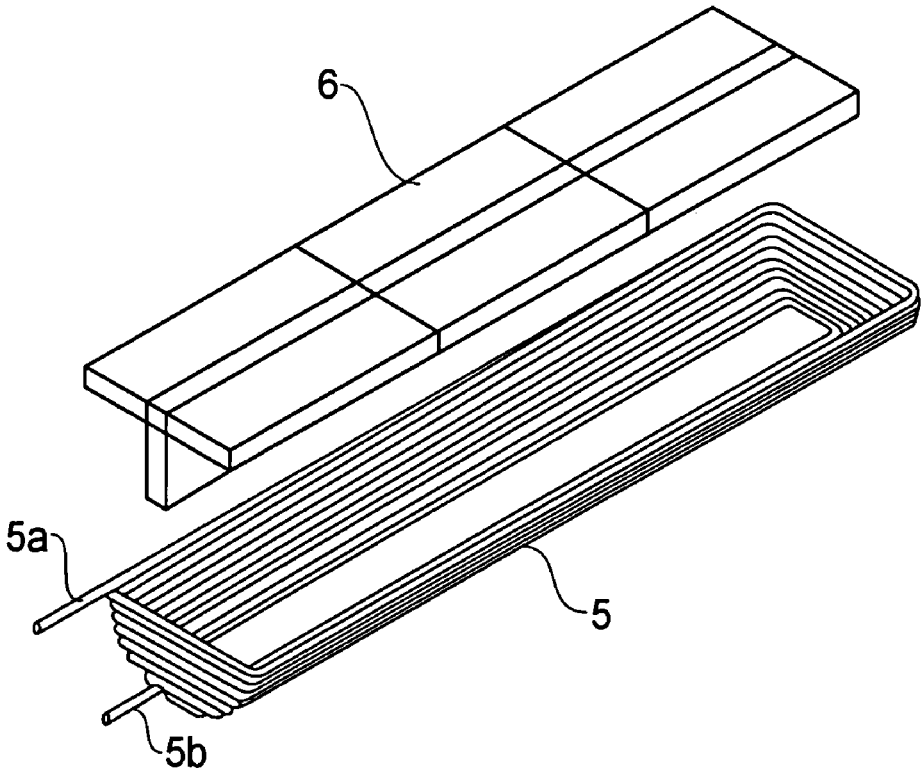
FIG. 5 is a schematic exploded perspective view of the induction heating coil and magnetic core.

FIG. 4 is a schematic perspective view of the excitation assembly 3, and FIG. 5 is an exploded schematic perspective view of the combination of the induction heating coil and the magnetic core, as a magnetic flux generating means. The excitation assembly 3 in this embodiment is an assembly made up of a holder 4, an induction heating coil 5 (excitation coil) as an exciting means, a magnetic core 6, a stay 7, etc.

The holder 4 is in the form of a trough, the cross section of which is semicircular. Its external diameter is slightly smaller than the internal diameter of the fixation roller 1. Within the hollow of the holder 4, the induction heating coil 5 and magnetic core 6 are held. The holder 4 is formed of a substance, which is not only heat resistant, but also, has a substantial amount of mechanical strength; for example, PPS resin which contains glass fiber. Obviously, it is non-magnetic. As for the substances suitable as the material for the holder 4, there are PPS resin, PEEK resin, polyimide resin, polyamide resin, polyamide-imide resin, ceramic, liquid polymer, fluorinated resin, and the like.

The induction heating coil 5 as an exciting means must be capable of generating an alternating magnetic flux strong enough for heating. Thus, it must be low in electrical resistance and high in inductance. As the core wire of the inductive heating coil 5, Litz wire is used, which is made up of roughly 80-160 strands of fine wires, the diameter of which is in the range of 0.1-0.3 mm, which are bound together. As the fine wire, electrical wire covered with insulating substance is used. The Litz wire is wound 8-12 times around the magnetic core 6, making up the induction heating coil 5, so that the portion of the contour of the induction heating coil 5, which faces the bottom portion of the internal surface of the holder 4, matches in curvature the contour of the internal surface of the holder 4. Since the Litz wire is wound around the magnetic core 6 which is rectangular, the resultant induction heating coil 5 has a shape resembling that of a long boat. The induction heating coil 5 is disposed in the hollow of the holder 4, in a manner of being fitted into the holder 4. Designated referential symbols 5*a* and 5*b* are lead wires extended outward of the holder 4, from the above described induction heating coil 5.

The magnetic core 6 is formed of such a magnetic substance as ferrite or Permalloy, which is high in magnetic permeability and low in residual magnetic flux density. It functions to guide the magnetic flux generated by the induction heating coil 5, to the sleeve 1*a* of the fixation roller 1, which is formed of one of the aforementioned magnetic conductors. The magnetic core 6 in this embodiment is T-shaped in cross section. It is the combination of two magnetic portions: the portion which is comparable to the horizontal portion of a letter T, and the portion which is comparable to the vertical portion of a letter T.

The stay 7 is formed of a resin or a metallic substance, which is nonmagnetic. It is rigid and is in the form of a long and narrow plate. It is firmly attached to the holder 4 in a manner of covering the opening of the holder 4 in which the induction heating coil 5 and fixation roller 1 are disposed. As described above, the excitation assembly 3 is inserted into the hollow of the fixation roller 1, and is firmly supported between and by the rear and front supporting members 24 and 24, by the rear and front lengthwise ends, so that a preset amount of gap is created and maintained between the internal surface of the fixation roller 1 and the excitation assembly 3, and also, so that the excitation assembly 3 is positioned at a preset angle in terms of the rotational direction of the fixation roller 1.

With the provision of the above described structural arrangement, as the driving force source M is started, the fixation roller 1 is rotated, and the pressure roller 2 is rotated by the rotation of the fixation roller 1. While the two rollers 1 and 2 are rotating, the induction heating coil 5 is provided with alternating electric current (high frequency electric current), the frequency of which is in the range of 20 kHz-500 kHz, through the pair of lead wires 5*a* and 5*b* extending from an electric power source 31, as an electric power supplying means, for induction heating. As the induction heating coil 5 is supplied with alternating current, it generates an alternating magnetic flux. This alternating magnetic flux is guided by the magnetic core 6 to the sleeve 1*a* of the fixation roller 1, which is formed of a magnetic conductor, being thereby applied thereto. As the alternating magnetic flux is applied to the sleeve 1*a*, eddy current is induced in the sleeve 1*a*. This eddy current generates heat (Joule heat) in the wall of the sleeve 1*a*; the sleeve 1*a* is heated by electromagnetic induction. As a result, the fixation roller 1 increases in temperature.

Figure 6:
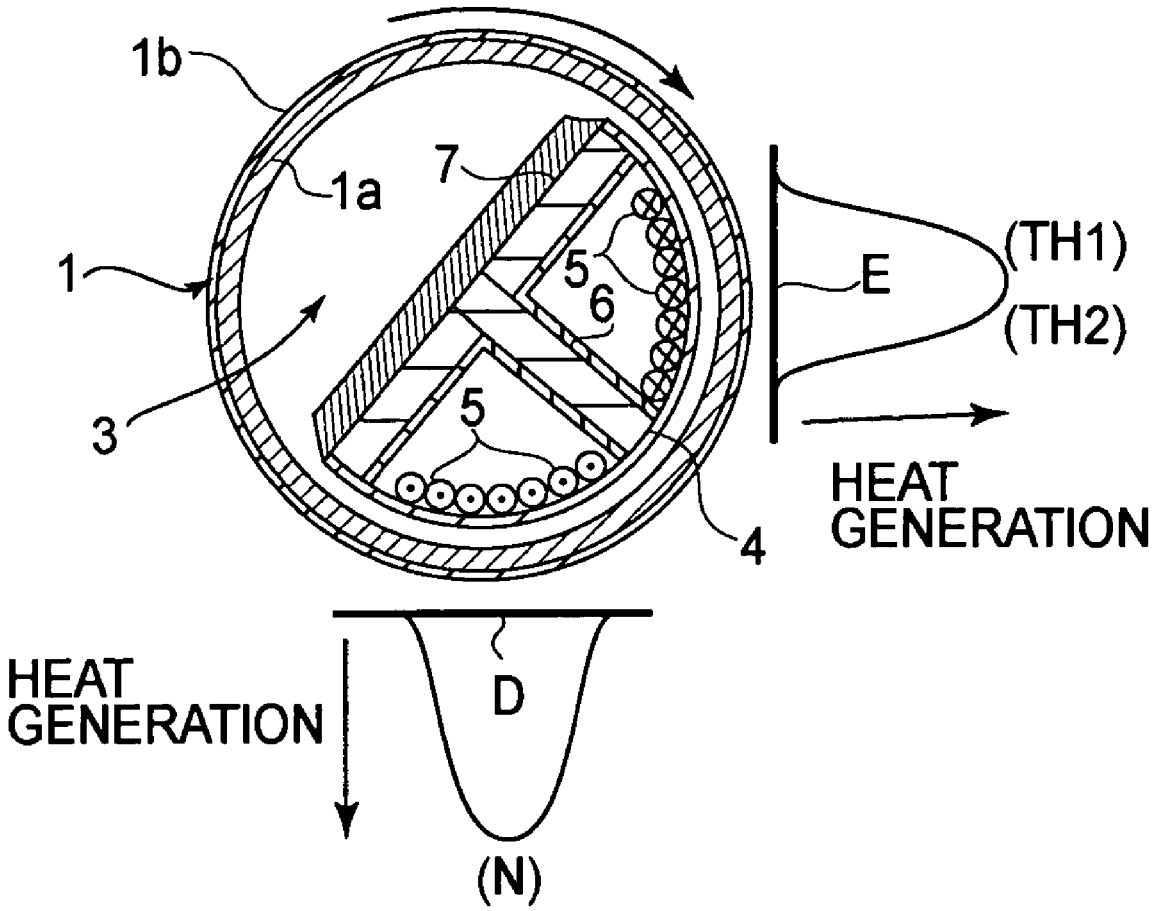
FIG. 6 is a drawing for describing the portion of the fixation roller, across which it is heated.

The fixing apparatus 100 is structured so that because of the shape in which the fine wires of the induction heating coil 5 is wound, only the portions of the fixation roller 1, which are directly facing the induction heating coil 5, are heated by the magnetic flux generated by the excitation assembly 3. Referring to FIG. 6, in this embodiment, only the portions of the fixation roller 1, which are in the two areas of the adjacencies of the peripheral surface of the induction heating coil 5, more specifically, ranges D and E in FIG. 6, are heated. Therefore, the fixing apparatus is controlled so that when the fixing apparatus is started up, or while a sheet P of recording medium is conveyed through the fixing apparatus, the heating of the fixation roller 1 is preceded by the starting of the rotation of the fixation roller 1, preventing thereby the problem that the surface temperature of the fixation roller 1 becomes nonuniform in terms of the rotational direction of the fixation roller 1, that is, the problem that high temperature spots are created (certain ranges of the peripheral surface of the fixation roller 1, in terms of the rotational direction of the fixation roller 1, become substantially higher in temperature than the rest. In this embodiment, the excitation assembly 3 is angled, in terms of the rotation direction of the fixation roller 1, so that the heating range D, that is, one of the ranges in which the fixation roller 1 is heated, coincides in position with the fixation nip N. As for the other heating range E, first and second temperature detection elements TH1 and TH2 (temperature sensors) as temperature detecting means for detecting the surface temperature of the fixation roller 1 are disposed in this range. The information regarding the surface temperature of the fixation roller 1 detected by the first and second temperature detection elements TH1 and TH2 is inputted into a controller 32 as an electric power application controlling means. The first and second temperature detection elements TH1 and TH2 as temperature detecting means will be described later.

The controller 32 controls the amount by which electric power is supplied from the induction heating power source 31 to the induction heating coil 5, based on the information regarding the surface temperature of the fixation roller 1 inputted from the first temperature detection element TH1, so that the surface temperature of the fixation roller 1 is maintained at a preset fixation temperature TR2.

With the surface temperature of the fixation roller 1 kept at the preset fixation temperature, a sheet P of recording medium (which hereinafter will be referred to simply as recording sheet P), as an object to be heated, onto which an unfixed toner image t have been transferred from the image forming means, is introduced into the fixation nip N, and is conveyed through the fixation nip N, with the sheet P remaining pinched between the fixation roller 1 and pressure roller 2. As a result, the unfixed toner image t on the recording sheet P is fixed to one of the surfaces of the recording sheet P by the heat from the fixation roller 1 and the pressure in the fixation nip N.

Referring FIG. 2, designated by a referential symbol A is the path of a recording sheet P, which is the largest in terms of the direction perpendicular to the recording sheet conveyance direction. Designated by a referential symbol B is the path of a recording sheet P, which is smaller in width than the largest recording sheet. Incidentally, in this embodiment, a recording sheet P is conveyed through the fixing apparatus so that the center of the recording sheet P coincides with the lengthwise center of the fixation roller 1; designated by a referential symbol O is the referential line which coincides with the center of the recording sheet P. Designated by referential symbols B' and B' are the areas between the lateral edges of the path B of the small recording medium P and the lateral edges of the path A of the largest recording medium, that is, the portions of the path A of the largest recording medium, with which the small recording medium does not come into contact with as it is conveyed through the fixing apparatus.

The first temperature detection element TH1 is disposed in contact, or almost in contact, with the portion of the fixation roller 1, which is within the path B of the small recording medium, whereas the second temperature detection element TH2 is disposed in contact, or almost in contact with, one of the portions of the fixation roller 2 which are within the portions B' of the path A of the largest recording medium.

When multiple small recording mediums P are continuously conveyed through the fixing apparatus, the portions of the fixation roller 1, which are in the portions B' of the path A of the largest recording medium, increase in temperature beyond the preset fixation temperature TR2. However, as the temperature of these portions of the fixation roller 1 increases past a permeability changing point, which is lower than the Curie point TR3 of the fixation roller 1, the fixation roller 1 begins to reduce in the efficiency with which heat is generated therein. Consequently, the temperature of these portions of the fixation roller 1 converges to the Curie point TR3, at which the permeability of the fixation roller 1 is 1; in other words, the temperature of these portions of the fixation roller 1 are prevented from increasing in temperature beyond the Curie point TR3 (portions of fixation roller outside recording medium path controls themselves in temperature). In this embodiment, the Curie point TR3 of the fixation roller 1 is set to be lower than the hot-offset starting point, preventing thereby the hot-offset attributable to the excessive increase in temperature of the portions of the fixation roller 1, which are in the portions B' and B', that is, the out-of-recording medium path, of the path A of the largest recording medium.

(3) Structure of Fixation Control System

1) Basic Control

Figure 7:
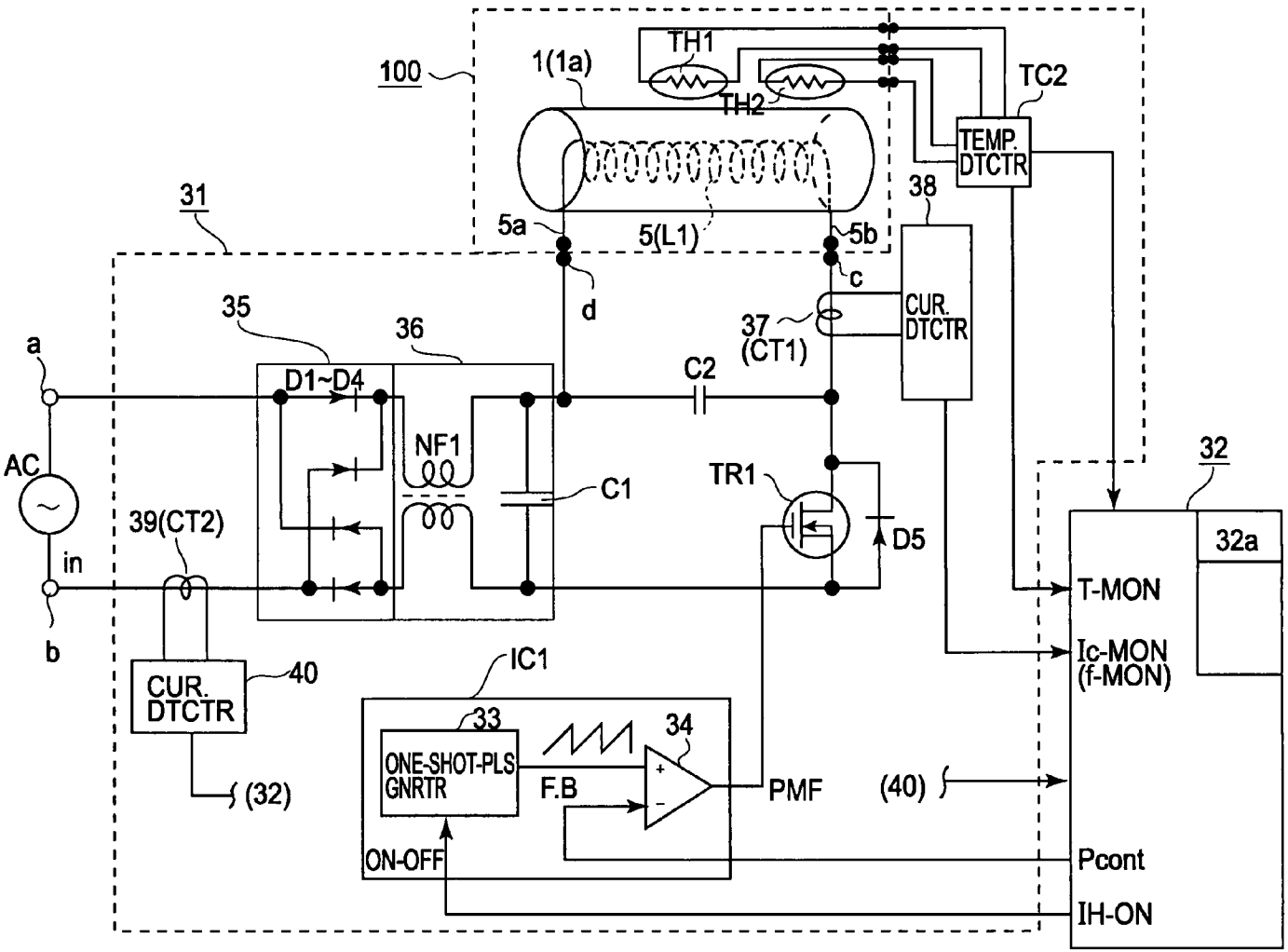
FIG. 7 is a block diagram of the control system of the fixing apparatus which employs an inductive heating method.

FIG. 7 is a block diagram of the fixation control system of the fixing apparatus employing the above described inductive heating method.

Designated by a referential symbol 31 is an induction heating power source (excitation circuit, electric power applying means, electric power converting apparatus), which supplies alternating electric current to the induction heating coil 5, as an exciting means, of the excitation assembly 3 disposed (inserted) in the hollow of the fixation roller 1 as a heating member. In other words, the induction heating power source 31 as an electric power supplying means is such an electric power supplying means that is capable of varying in frequency and amplitude the electric power supplied to the induction heating coil 5 to heat the fixation roller 1.

Designated by a referential symbol 32 is the controller as an electric power controlling means, which varies the amount by which the above described induction heating power source 31 supplies electric power to the induction heating coil 5 (electric power conversion control).

In the induction heating power source 31, designated by a referential symbol TR1 is an electric power switching element made up of an IGBT or a MOS-FET, and designated by a referential symbol C2 is a resonant capacitor for converting the waveform of the high frequency alternating current applied to the induction heating coil 5 as a load, into the resonant waveform. Designated by a referential symbol D5 is a flywheel diode for regenerating the electric power stored in the induction heating coil 5.

As described above, the first and second temperature detection elements TH1 and TH2, respectively, are positioned in the heating range E (FIG. 6), which is one of the heating ranges which are highest in the amount by which heat is generated in the wall of the fixation roller 1 (1*a*), being thereby thermally closely tied to the fixation roller 1. As the first and second temperature detection elements TH1 and TH2, it is common practice to employ so-called thermosensitive resistors such as a thermistor. Their outputs are inputted into a temperature detection circuit IC2, which outputs voltages, the values of which are proportional to the changes in the electric resistance of the temperature detection elements TH1 and TH2. The outputs from the temperature detection circuit IC2 are inputted into the controller 32.

The output of the first temperature detection element TH1 is inputted as a temperature signal T-MON into the controller 32, which controls the resonance control circuit IC1 of the induction heating power source 31, based on the output of the first temperature detection element TH1.

The controller 32 controls the operation for supplying the fixation roller 1 of the fixing apparatus 100 with electric power, according to the operational state (whether it is in startup process, actually copying, on standby, or another process) of the copying machine; it controls the timing with which the fixing apparatus is supplied with electric power, and the amount by which the fixing apparatus is supplied with electric power.

The resonance control circuit IC1 has a one-shot pulse generation circuit 33, a comparison circuit 34. To the one-shot pulse circuit IC1, a power command value $P_{cont}$ (target amount for electric power) is inputted from the controller 32. To the comparison circuit 34, an operation authorization signal for controlling the oscillating operation itself of the resonance control circuit IC1 is inputted. After being inputted into the resonance control circuit IC1, the power command value $P_{cont}$ is inputted as a power control signal into the pulse modulation (which hereinafter will be referred to as PFM) oscillation circuit in the resonance control circuit IC1. The resonance control circuit IC1 generates a PFM pulse which matches the power command value $P_{cont}$, and outputs it to the gate of the electric power switching element TR1, driving thereby the electric power switching element TR1.

Designated by a referential symbol AC is a commercial alternating current power source. The electric power inputted from this power source AC into the input terminals a and b of the induction heating power source 31 is rectified by an input power rectification circuit 35 made up of diodes D1-D4 connected in the bridging fashion, and then, is flowed through a smoothing circuit 36 (noise filter) made up of an input noise filter NF1 and a smoothing condenser C1, being thereby supplied as pulsating current, which results from the rectification of alternating current, to a power control circuit portion. The smoothing circuit 36 is set to such a constant that ensures that the switching frequency of the electric power switching element TR1 is attenuated by a sufficient amount, whereas the electric power source frequency passes without being attenuated.

Designated by a referential symbol 37 is a current detection transformer (CT1). Designated by a referential symbol 38 is a coil current detection circuit, which detects the amount of current flowing from the induction heating power source 31 to the induction heating coil 5, and inputs the results of the detection to the controller 32. The controller 32 computes the amount $P_{coil}$ of the power supplied to the coil 5, based on this amount of current detected by the coil current detection circuit 38.

Designated by a referential symbol 39 is a current detection transformer (CT2). Designated by a referential symbol 40 is a coil current detection circuit, which detects the amount of the current flowing from the commercial alternating current power source to the induction heating power source 31, and inputs the detected amount into the controller 32, which computes the amount of the inputted amount of power, based on the detected amount of the current.

Next, the operation of the fixation control system will be described. As the controller 32 receives a heating start signal (signal for starting up fixing apparatus) at the starting of a copying operation, it outputs the operation authorization signal IH-ON and power command value $P_{cont}$, to the resonance control circuit IC1 of the induction heating power source 31, according to the operational state of the copying machine. As a result, the resonance control circuit IC1 outputs a high frequency PFM signal.

In other words, an alternating current input voltage is applied to the input terminals a and b of the induction heating power source 31. As the alternating current input voltage is applied to the induction heating power source 31, the voltage is rectified by the current rectifying elements D1-D4 of the input power rectification circuit 35, into pulsating current, the voltage of which is applied to the terminals of the by-pass condenser C1 (smoothing condenser) through the input noise filter NF1 of the smoothing circuit 36. Therefore, the voltage between the terminals of the bypass condenser C1 has the waveform resulting from the rectification of the inputted alternating current voltage.

From the controller 32, a preset power command value $P_{cont}$ is applied as a control signal to the PFM oscillation circuit of the resonance control circuit IC1. The resonance control circuit IC1 generates and outputs a PFM signal, the pulse of which matches that of the control signal. This output from the resonance control circuit IC1 is applied between the gate sources of the power switching element TR1, turning on the power switching element TR1. As a result, drain current ID flows, supplying thereby the induction heating coil 5 with power.

The current which flows as the power switching element TR1 is turned on is stored in the induction heating coil 5. Therefore, as the power switching element TR1 is turned off, the induction heating coil 5 generates such voltage that is opposite in polarity to the current which was being supplied to the induction heating coil 5. As a result, the resonance condenser C2 is charged by the electric power which has been stored in the induction heating coil 5. In other words, the voltage of the resonance condenser C2 is increased by the current which flows into the condenser C2 from the induction heating coil 5 which has been storing electric power.

The current which flows out of the induction heating coil 5 attenuates in reverse proportion to the increase in the voltage of the resonance condenser C2, eventually stops flowing. As soon as current stops flowing from the induction heating coil 5, the electrical charge having accumulated in the resonance condenser C2 begins to move toward the induction heating coil 5; electric current begins to flow toward the induction heating coil 5.

Thereafter, at the same time as the electric charge having been stored in the resonance condenser C2 returns to the induction heating coil 5, the oscillation voltage drops. At the point in time at which the electric charge having been stored in the resonance condenser C2 completely discharges, current is flowing again through the induction heating coil 5 in the reverse direction. Therefore, the drain voltage of the power switching element TR1 is rendered lower than the source voltage, by this voltage which is reverse in polarity. As a result, the flywheel diode D5 is turned on, allowing thereby current to flow in the forward direction.

After a certain length of time, an on-signal is supplied to the power switching element TR1, turning on the power switching element TR1. As the power switching element TR1 is turned on, current flows forward in the induction heating coil 5, and accumulates in the induction heating coil 5. The above described sequence is repeated. As a result, current is induced in the fixation roller 1 (1*a*), which is in the immediate adjacencies of the induction heating coil 5 and constitutes a load which is electromagnetically connected to the induction heating coil 5. Consequent, the fixation roller 1 (1*a*) formed essentially of a magnetic conductor generates heat (Joule heat) by the amount equal to the product between the electrical resistance of the fixation roller 1 (1*a*) and the square of the amount of the current induced in the fixation roller 1 (1*a*). In other words, the wall of the fixation roller 1 is efficiently heated from within. Since the fixation roller 1 is being rotated, it is heated in its entirety.

In this fixation control system, the high frequency component of the current which flows through the switching element TR1 and induction heating coil 5L1 is smoothed by the bypass condenser C1 through charging and discharging processes. Therefore, high frequency current does not flow to the input noise filter NF1; only alternating current which is identical in waveform to the inputted alternating current flows through the input noise filter NF1.

The current which flows through the rectification diode D1-D4 of the input power rectification circuit 35 turns into the current waveform, which is effected as the current waveform having flowed through the switching element TR1 and induction heating coil 5 is filtered by the smoothing circuit 36 made up of the bypass condenser C1 and input noise filter NF1. Therefore, the waveform of the alternating input current turns into an input current waveform which closely resembles the waveform of the alternating input current. Therefore, the high frequency component in the input current is substantially reduced, which results in the substantial improvement, in power factor, of the input current of the induction heating power source 31.

The input noise filter NF1 and bypass condenser C1 which make up the smoothing circuit 36 in this circuit have only to be effective to filter the high frequency component of the current from the resonance control circuit IC1. Therefore, the bypass condenser C1 and input noise filter NF1 may be reduced in capacity and inductance, respectively, making it possible to reduce the circuit in size and weight.

Into the induction heating power source 31 designed as described above, the power command value $P_{cont}$ is inputted from the controller 32. Therefore, high frequency alternating electric power, the frequency of which is in the range of 20 kHz-1 MHz, can be generated at the output terminals c and d of the induction heating power source 31.

The outputs of the first and second temperature detection elements TH1 and TH2 for measuring the surface temperature of the fixation roller 1 are continuously inputted into the temperature detection circuit IC2, which converts the outputs of the temperature detection elements TH1 and TH2 into temperature signals, and outputs the temperature signals. The temperature signals outputted from the temperature detection circuit IC2 are inputted into the controller 32, which continuously compares the surface temperature of the fixation roller 1 detected by the temperature detection element TH1, with the target temperature. The difference between the surface temperature of the fixation roller 1 detected by the temperature detection element TH1 and the target temperature is fed back as the power command value $P_{cont}$ of the resonance control circuit IC1.

The controller 32 internally stores the target surface temperature for the fixation roller 1. As the surface temperature of the fixation roller 1 detected by the first temperature detection element TH1 increases close to this target temperature stored in the controller 32, the controller 32 generates a feed back signal for keeping constant the surface temperature of the fixation roller 1. As for the method for keeping constant the surface temperature of the fixation roller 1, such a control method as the proportional control method, so-called PID control method, or the like for reducing the amount by which high frequency power is supplied to the induction heating coil 5 is employed.

The controller 32 computes the difference between the surface temperature of the fixation roller 1 detected by the temperature detection circuit IC2 and the target temperature for the fixation roller 1, and outputs the difference as the power command value $P_{cont}$ to the resonance control circuit IC1. The resonance control circuit IC1 sets the length of time the gate of the power switching element TR1 is to be kept turned on, based on the inputted power command value $P_{cont}$, adjusting thereby the amount by which power is supplied to the power switching element TR1. As a result, the power supplied to the induction heating coil 5 is controlled, and therefore, the amount by which heat is generated in the wall of the fixation roller 1 is controlled. Consequently, the temperature of the fixation roller 1 is stabilized at the fixation temperature TR2.

2) Identification of Mounted Fixation Roller, and Control Modification for Compensating for Difference Among Various Types of Fixation Roller 1

As described above, in this embodiment, the fixing apparatus is provided with the fixation roller 1, which is formed of a magnetic conductor, the Curie point of which is higher than a preset fixation temperature, and in the wall of which heat is electromagnetically generated by the function of alternating magnetic flux generated by the induction heating coil 5 to thermally fix an unfixed image t on recording medium. Further, the fixing apparatus is enabled to operate in the control modification mode, in which while the fixation roller 1 is increased in temperature during the startup period of the fixing apparatus, the characteristic of the mounted fixation roller 1 regarding its temperature increase is detected, and its power controlling method is modified to accommodate the characteristic of the mounted fixation roller 1 regarding temperature increase. More concretely, while the fixation roller 1 is increasing in temperature during the startup period of the fixing apparatus, the characteristic of the mounted fixation roller 1 regarding temperature increase is detected from the amount of the alternating current power supplied to the induction heating coil 5, and the information regarding the temperature detected by the first temperature detection element TH1. Then, the amount by which power supplied to the induction heating coil 5 is controlled according to the detected characteristic of the fixation roller 1 regarding temperature increase. Hereafter, this modification of the control method will be described in detail.

Generally, a fixing apparatus which heats an object by electromagnetic induction is provided with a fixation roller such as the above described fixation roller 1, which is formed of a magnetic conductor, the Curie point of which has been preset. Thus, if a fixation roller which does not meet the tolerance in terms of the Curie point is mounted in a fixing apparatus, or the fixation roller mounted in a fixing apparatus is not the normal fixation roller, that is, such a fixation roller that does not match in type the fixing apparatus in which it is mounted, the fixation process cannot be properly controlled.

Figure 8:
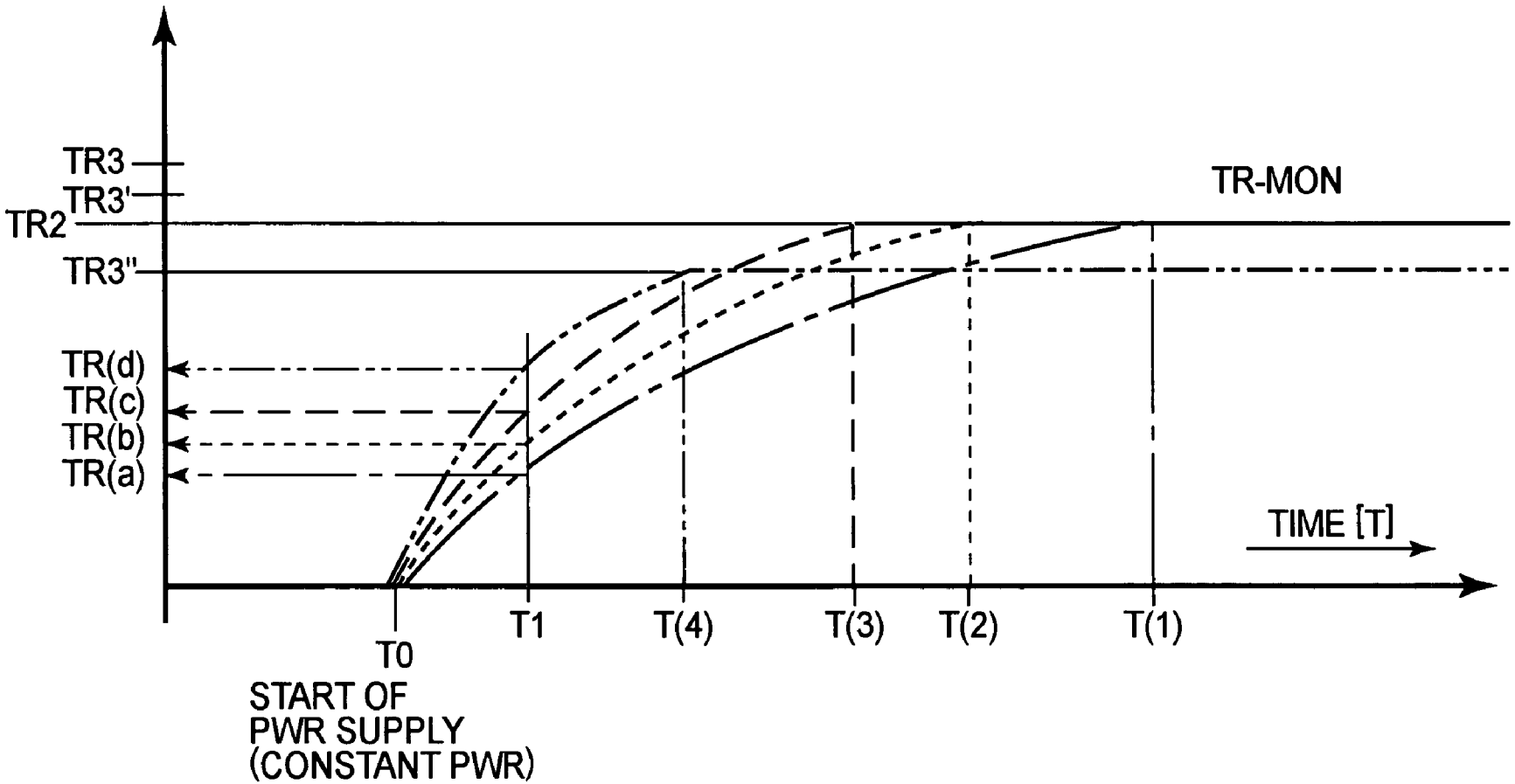
FIG. 8 is a graph showing the profiles of various fixing apparatuses different in Curie point, regarding the increase in their temperature which occurs as they are started up (with amount by which electric power is supplied being kept constant).

The fixation roller 1 (1*a*) is formed of one of magnetic conductors, for example, such an iron alloy as Fe—Cr—Ni, the Curie point of which is in the adjacencies of the preset fixation temperature. The magnetic conductors different in Curie point are different in heat generation efficiency. That is, if a given magnetic conductor is different in composition from another magnetic conductor, the two are different in specific resistivity. Therefore, the fixation rollers (1)-(4), which are different in properties, more specifically, Curie point, are different in heat generation profile, that is, the rate at which they increase in temperature during the startup period, as shown in FIG. 8, provided that they are the same in the amount by which they are supplied with electric power. In other words, if fixation rollers different in Curie point are supplied with electric power by the same amount, that is, the amount corresponding to the electric power supply command value computed based on the fixation roller temperature and target fixation temperature, they become different in the length of the startup time. For example, in the case of the aforementioned iron alloy, the higher the Cr content, the higher in specific resistivity and lower in Curie point, being therefore higher in the ratio of the amount of the heat generated therein to the amount of the electric current supplied to the induction heating coil 5 for heat generation, compared to pure iron. This is for the following reason. That is, if two fixation rollers are different in material, the two are different in the amount of the load resistance of the coil, as seen from the power source side. Therefore, even when the two rollers are the same in the difference between their current temperatures and target fixation temperatures, and also, the same in the power supply command value, they are different in the actual amount by which electric power is supplied to the induction heating coil 5.

The fixation roller (1) has a metallic core formed of pure iron, and therefore, its heat generation profile is basically the same as that of pure iron, the Curie point of which is very high. Therefore, it does not occur that within the temperature range in which the fixation roller (1) is used, the temperature of the fixation roller (1) reaches its Curie point. The fixation roller (2) is a fixation roller, the Curie point of which is the same as the preset Curie point TR3 of the fixation roller of the fixing apparatus in this embodiment. In other words, the Curie point TR3 of this fixation roller (2) is higher by a preset amount than the fixation temperature TR2.

The fixation roller (3) is a fixation roller, the Curie point TR3' of which is higher than the fixation temperature TR2 of the fixation roller (2), but is lower than the Curie point TR3 of the fixation roller (2).

The fixation roller (4) is a fixation roller, the Curie point TR3" of which is lower than the fixation temperature TR2 of the fixation roller (2).

The lower in Curie point the fixation roller ((1)-(2)-(3)-(4)), the higher in specific resistivity, compared to iron, being therefore greater in the amount of the heat generated therein by the electric current flowed to the induction heating coil 5 for heat generation, being therefore greater in the gradient at which its temperature increases during the startup period, being therefore shorter in the length of the time for the temperature of the fixation roller to rise the target fixation temperature TR2. However, the Curie point TR3" of the fixation roller (4) is lower than the fixation temperature TR2 of the fixation roller (2). Therefore, as the temperature of the fixation roller (4) rises close to its Curie point TR3", which is lower than the target fixation temperature TR2, the fixation roller (4) enters the state in which its temperature no longer rises; it controls itself in temperature. Therefore, the temperature of the fixation roller (4) never rises to the target fixation temperature TR2.

Therefore, there is the following relationship among the fixation rollers (1)-(4), in terms of the temperature levels TR(a), TR(b), TR(c), and TR(d), which they reach, respectively, during the period from the point T0 in time at which electric power begins to be supplied, to the point T in the startup period: TR(a)<TR(b)<TR(c)<TR(d), respectively.

Therefore, the fixation rollers (1)-(4), which are different in Curie point, can be identified using the above described differences among them in their characteristics in temperature increase during the startup period.

In this embodiment, the fixation roller 1 in a fixing apparatus is identified using the above described criterion, during a part of the control carried out when the fixing apparatus is started up, that is, immediately after the fixing apparatus is turned on. Then, even if the fixation roller in the fixing apparatus happens to be a fixation roller which does not meet the preset tolerance, or a fixation roller, the Curie point of which is not the normal one for the type of the fixing apparatus, the amount by which electric power is supplied to the fixation roller is controlled so that it matches the Curie point of the fixation roller in the fixing apparatus; in other words, it is made possible for the fixing apparatus to be properly controlled.

Next, referring to FIG. 9, which is a diagram showing the sequence for starting up the fixing apparatus in this embodiment, and FIG. 10, which is a flowchart showing the control carried out during the startup period, how the fixation roller in the fixing apparatus is identified in type, and also, how the control carried out during the start up period is modified according to the identified type of a fixation roller, will be described.

Before the controller 32 starts an actual copying operation, it starts the startup operation (START) for raising the temperature of the fixation roller 1 to a preset level.

First, the controller 32 activates a timing means 32*a* as a clocking means, and then, outputs a signal IH-ON for turning on the induction heating power source 31, while clocking the elapsed time.

The operation for heating the fixation roller 1 is started by supplying the induction heating coil 5 with electric power $P_{coil}$, the pulse width of which is kept fixed to a pulse width of P1 during this period.

As the clocking means 32*a* detects that a preset length of time (which corresponds to point T1) has elapsed after the heating of the fixation roller 1 is started, the controller 32 reads the surface temperature TR of the fixation roller 1 through the first temperature detecting means TH1.

If the detected temperature of the fixation roller 1 is no less than TR(d), the controller 32 determines that the fixation roller in the fixing apparatus is a fixation roller, the Curie point of which is lower than the fixation temperature TR2. In this case, the controller 32 determines that the fixation roller in the fixing apparatus is not usable with the fixing apparatus, and stops the apparatus (ERR-STOP). Then, it shows, on the display (unshown), a warning message that prompts an operator to replace the fixing apparatus. The temperature TR(d) is the surface temperature, at the point T1 in time, of a fixation roller, the Curie point TR3" of which is lower than the preset fixation temperature TR2.

If the detected temperature TR of the fixation roller is close to TR(b), the controller 32, as an electric power amount changing means (means for adjusting amount by which electric power is supplied to coil 5), determines that the fixation roller in the fixing apparatus is the fixation roller (2), the Curie point of which matches the fixing apparatus. In this case, the controller 32 continues the startup heating operation, in which the pulse width of the electric power $P_{coil}$ applied to the coil 5 is the pulse width P1.

If the detected temperature TR of the fixation roller is close to TR(b), the controller 32, as the electric power amount changing means, determines that the fixation roller in the fixing apparatus is the fixation roller (1) (fixation roller having metallic core formed of iron) which is not as good as possible in terms of the rate of temperature increase during the startup period. Then, based on this determination, the controller 32 increases the amount by which electric power is supplied to the coil 5, to a preset value, by switching the pulse width of the electric power supplied to the coil 5, to a pulse width P1(*a*).

If the detected temperature TR of the fixation roller is close to TR(c), the controller 32 determines that the fixation roller in the fixing apparatus is a fixation roller, the Curie point of which is higher than the fixation temperature TR2 of the fixation roller (2), but is lower than the Curie point TR3 of the fixation roller (2). Then, based on this determination, the controller 32 changes in pulse width the electric power $P_{coil}$ supplied to the induction heating coil 5, reducing thereby the amount by which electric power is supplied to the coil 5.

As described above, the type of the fixation roller 1 can be identified by detecting the surface temperature TR of the fixation roller 1 at the specific point T1 in time while the fixation roller 1 is increasing in surface temperature. Thus, by controlling the amount by which electric power is supplied to the induction heating coil 5, according to the identified type (roller material), the fixation rollers (1), (2), (3), and (4) can be rendered uniform in the length of time it takes for the surface temperature of the fixation rollers (1), (2), (3), and (4) to reach the fixation temperature TR2 during the startup period; they all reach the fixation temperature TR2 at the same time of T2, as shown in FIG. 9, regardless of the material therefor, making it possible to improve a copying machine, a printer, and the like, not only in terms of energy conservation, and also, in terms of the actual impression of being easy to use, because the apparatus does not need to be stopped for fixation roller replacement.

Figure 9:
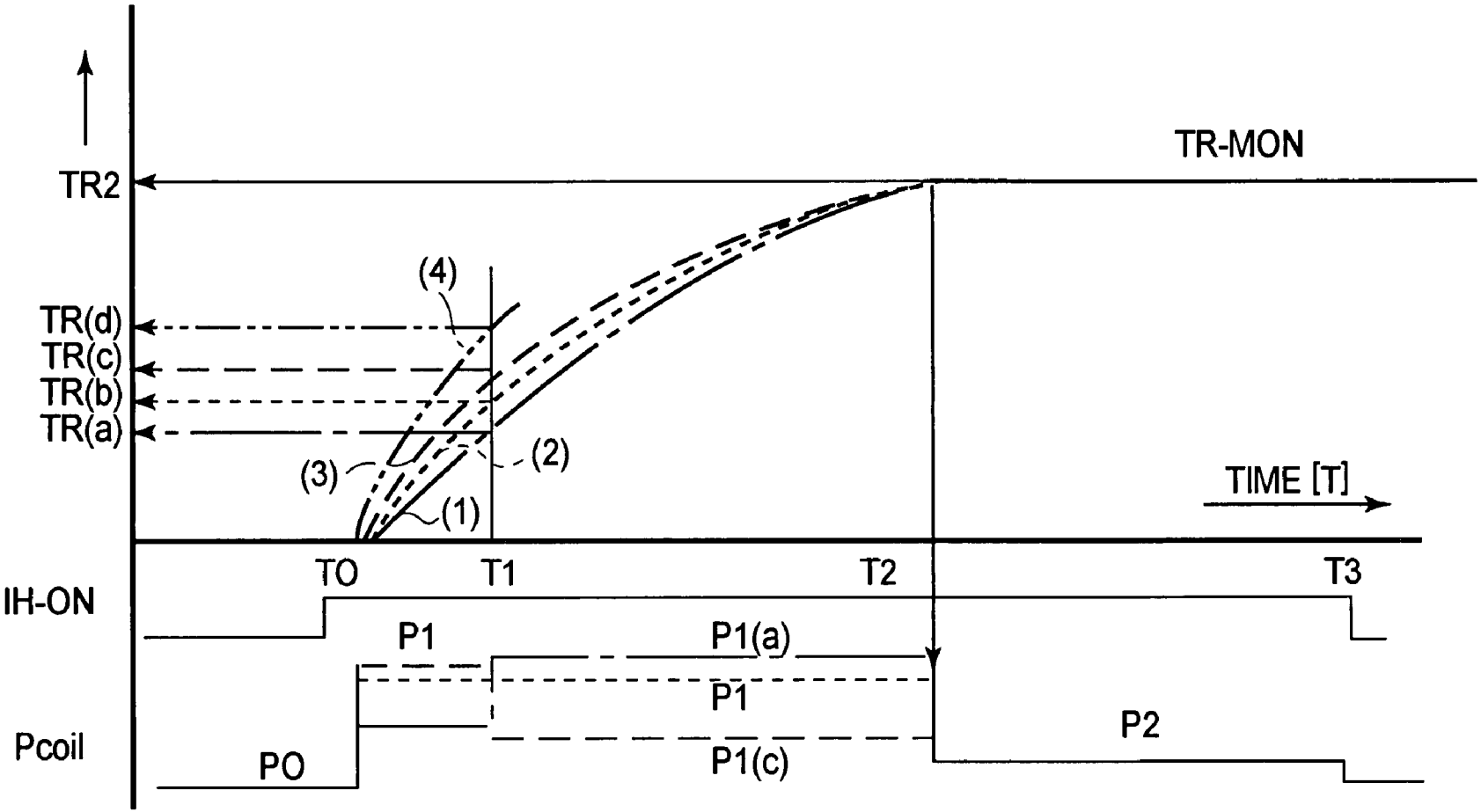
FIG. 9 is a graph showing the sequence for identifying the type of the fixation roller in the heating apparatus, and the sequence for switching the control of the heating apparatus according to the identified type of the fixation roller in the heating apparatus.
Figure 10:
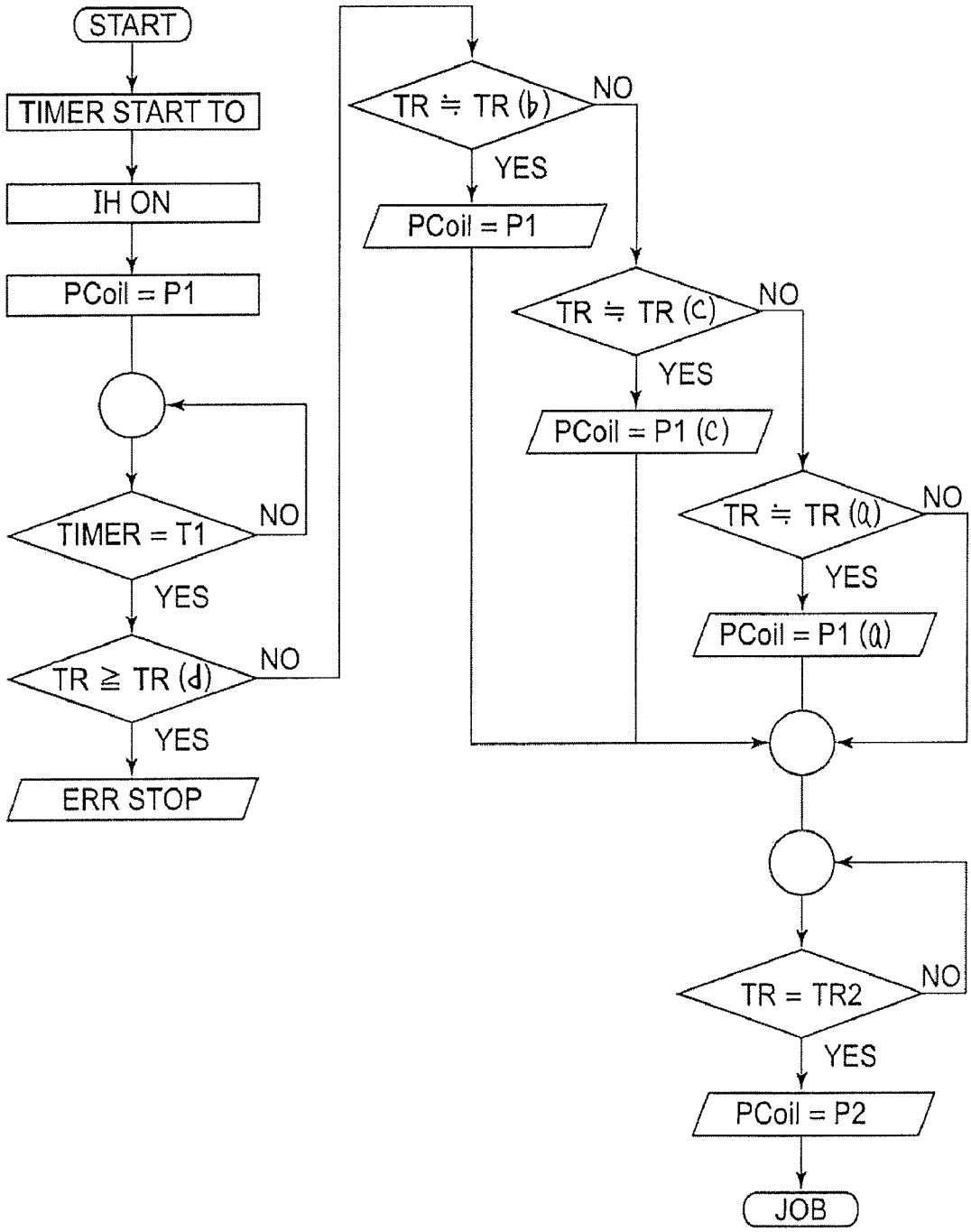
FIG. 10 is a flowchart of the control of the fixing apparatus in accordance with the present invention.

Referring to FIG. 9, the pulse width P2 is the pulse width of the electric power which begins to be supplied to the induction heating coil 5 immediately after the completion of the startup operation, in order to start a copying (printing) operation immediately after the completion of the startup operation. In other words, it is the pulse width of the electric power supplied to the coil 5 while a sheet of recording medium is conveyed through the fixation portion. The point T3 in time coincides with the point in time at which the copying (printing) operation is ended, and at which the pulse width of the electric power supplied to the coil 5 is reduced to the pulse width P2. In other words, the point T3 in time at which the pulse width is reduced from the pulse width P2 coincides with the end of the copying operation.

The fixation roller 1 of the image heating apparatus in this embodiment is removably mountable in the image heating apparatus, and therefore, it is possible that one of the fixation rollers different from the fixation roller 1 in this embodiment, in terms of one of their characteristics, more specifically, the characteristic regarding temperature increase, will be mounted in the image heating apparatus. In other words, it is possible that a fixation roller matching an image heating apparatus different in type from the image heating apparatus in this embodiment will be mounted in the image heating apparatus in this embodiment, creating an unexpected combination of a fixing apparatus and the main assembly of an image forming apparatus. In this embodiment, however, even if such a combination as the above described one occurs, that is, a mismatch occurs between the fixing apparatus 100 and image forming apparatus main assembly, the above described characteristic of the fixation roller 1 regarding temperature increase during the startup period can be easily detected. Therefore, the problems which may be caused by the mismatch can be prevented.

Incidentally, the Curie point of the fixation roller (1) is higher than the Curie point TR3 of the normal fixation roller (2). Therefore, when continuously conveying multiple recording mediums of a small size, the controller 32 watches the temperature increase of the portion of the fixation roller outside the recording medium path of the recording medium being currently conveyed, with the use of the second temperature detecting means TH2, and controls the image forming operation so that the portion of the fixation roller outside the recording medium path does not excessively increase in temperature; more specifically, the controller 32 adjusts the length of the recording medium intervals to prevent the temperature of the portion of the fixation roller outside the recording medium path, from exceeding the preset temperature limit of TR3.

Further, if the controller 32 detects that the temperature of the fixation roller inputted from the first or/and second temperature detecting means TH1 and TH2 has exceeded the preset upper limit, it determines that a thermal runaway has occurred to the image heating apparatus. Then, it immediately stops the apparatus, and displays a message indicating the occurrence.

Incidentally, it is true that in this embodiment, even if the fixation roller in the image heating apparatus is identified as the fixation roller (1) or (3), the fixation roller in the image heating apparatus is not replaced, and is used while being controlled in temperature with the use of the electric power controlling method matching the fixation roller in the image heating apparatus. However, there is no doubt, in this case, that the fixation roller in the image heating apparatus is a mismatch to the image heating apparatus. Therefore, it is preferable that the image forming apparatus is structured so that when there is this kind of mismatch, a message prompting fixing apparatus replacement is displayed. It is also possible to structure an image forming apparatus so that if it is determined that the fixation roller in the image heating apparatus is the fixation roller (1), the operation is stopped, and a message prompting fixating apparatus replacement is displayed, as it is if the fixation roller in the fixing apparatus is determined to be the fixation roller (4).

Further, the referential temperatures TR(a), TR(b), and TR(c) used for identifying in type various fixation rollers may be replaced with referential temperature ranges, or a larger number of referential temperatures. It is also possible to provide a step-less temperature reference data so that a fixation roller can be identified in type based on its temperature detected at the point T1 in time.

As described above, the fixing apparatus in this embodiment, which uses, as the material for its fixation roller 1, a substance having its Curie point in the adjacencies of the fixation temperature of the fixation apparatus, and also, uses electromagnetic induction to heat the fixation roller 1, is characterized in that it comprises the controller 32 (controlling apparatus), and induction heating power source 31 (high frequency power converting apparatus) which varies the amount of electric power supplied to the induction heating coil 5 in response to a command from the controller 31, and the controller 32 identifies in type the fixation roller in the fixing apparatus, based on the characteristic of the fixation roller regarding the temperature increase during the startup period, and optimizes the amount by which electric power is supplied to heat the fixation roller 1, based on the identity of the fixation roller 1 in the image heating apparatus.

[Miscellanies]

1) The present invention is also applicable to such an image heating apparatus of the induction heating type that is provided with a magnetic flux blocking plate for preventing the portions of a fixation roller outside the recording medium path from excessively increasing in temperature, and a means for driving the magnetic flux blocking means, in order to prevent such problems as unsatisfactory fixation attributable to the mismatch in Curie point between the image heating apparatus and its heating member.
2) An image heating apparatus may be structured so that the excitation assembly 3 as an exciting means is disposed outside the fixation roller 1 as a heating member.
3) Not only is the image heating apparatus in accordance with the present invention usable as the fixing apparatus in this embodiment, but also, as an image heating apparatus for temporary fixation, a thermal processing apparatus for improving, in surface properties such as glossiness, a recording medium and the image borne thereon, by reheating the recording medium and the image borne thereon, and the like apparatuses.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 367623/2004 filed Dec. 20, 2004 which is hereby incorporated by reference.

What is claimed is:

1. An image heating apparatus comprising:

a coil for generating a magnetic flux by electric power supply thereto;

an image heating member that generates heat by magnetic flux from said coil and heats an image on a recording material;

a temperature detecting member for detecting a temperature of said image heating member;

electric power supply control means for controlling the electric power supply to said coil;

discriminating means for discriminating a temperature rising property of said image heating member during a period from start of the electric power supply to said coil to reaching of a predetermined temperature to heat an image;

electric power supply stop means for stopping the electric power supply in the case that the temperature rising property is out of a predetermined range; and changing means for changing an electric power value supplied to said coil to heat the image, in the case that the temperature rising property is within the predetermined range.

2. An apparatus according to claim 1, wherein the predetermined range corresponds to a Curie temperature property of said image heating member.

3. An apparatus according to claim 1, wherein the case that the temperature rising property is out of the predetermined range corresponds to a Curie temperature property in a temperature region in which a Curie temperature of said image heating member is lower than the image heating temperature.

4. An apparatus according to claim 1, wherein when the temperature rising property is smaller than a preset temperature rising property, said changing means changes the electric power value such that the electric power supply increases.

5. An apparatus according to claim 1, wherein when the temperature rising property is larger than a preset temperature rising property, said changing means changes the electric power value such that the electric power supply decreases.

6. An apparatus according to claim 1, further comprising a display portion for displaying information relating to said image heating member when said changing means changes the electric power value.

* * * * *

UNITED STATES PATENT AND TRADEMARK OFFICE

CERTIFICATE OF CORRECTION

PATENT NO. : 7,372,008 B2
APPLICATION NO. : 11/304732
DATED : May 13, 2008
INVENTOR(S) : Tomoichiro Ohta et al.

It is certified that error appears in the above-identified patent and that said Letters Patent is hereby corrected as shown below:

COLUMN 1
Line 45, “exceeds,” should read --exceed,--; and “above described” should read --above-described--.
Line 49, “warmup” should read --warm-up--.
Line 55, “hot-offset.” should read --hot offset.--.

COLUMN 2
Line 5, “increases” should read --increase--.
Line 27, “numbers,” should read --number,--.
Line 46, “type” should read --types--; and “a” should be deleted.
Line 58, “above described” should read --above-described--.

COLUMN 3
Line 16, “above described” should read --above-described--.

COLUMN 5
Line 36, “became” should read --becomes--.

COLUMN 7
Line 3, “above described” should read --above-described--.
Line 29, “above described” should read --above-described--.

COLUMN 8
Line 37, “Referring” should read --Referring to--.

COLUMN 9
Line 23, “above described” should read --above-described--.
Line 33, “that is” should read --that it is--.
Line 39, “above described” should read --above-described--.

COLUMN 11
Line 59, “above described” should read --above-described--.
Line 63, “Consequent,” should read --Consequently--.

COLUMN 12
Line 58, “feed back” should read --feedback--.

UNITED STATES PATENT AND TRADEMARK OFFICE

CERTIFICATE OF CORRECTION

PATENT NO. : 7,372,008 B2
APPLICATION NO. : 11/304732
DATED : May 13, 2008
INVENTOR(S) : Tomoichiro Ohta et al.

It is certified that error appears in the above-identified patent and that said Letters Patent is hereby corrected as shown below:

COLUMN 13
Line 46, “above described” should read --above-described--.
Line 50, “in” should read --to--.

COLUMN 14
Line 47, “rise” should read --rise to--.
Line 65, “above described” should read --above-described--.

COLUMN 15
Line 2, “above described” should read --above-described--.

COLUMN 16
Line 24, “and” should read --but--.
Line 52, “above described” should read --above-described--.
Line 55, “above described” should read --above-described--.

COLUMN 17
Line 28, “it is” should be deleted.

Signed and Sealed this

Seventeenth Day of February, 2009

JOHN DOLL
*Acting Director of the United States Patent and Trademark Office*